US010694874B2

(12) United States Patent
Fulkerson et al.

(10) Patent No.: US 10,694,874 B2
(45) Date of Patent: Jun. 30, 2020

(54) LATEX FOAM PILLOW

(71) Applicant: Sealy Technology, LLC, Trinity, NC (US)

(72) Inventors: Michael J. Fulkerson, Pocono Summit, PA (US); Edward K. Wolff, Pottsville, PA (US); Angela Li, Mountain Top, PA (US)

(73) Assignee: Sealy Technology, LLC, Trinity, NC (US)

( * ) Notice: Subject to any disclaimer, the term of this patent is extended or adjusted under 35 U.S.C. 154(b) by 0 days.

(21) Appl. No.: 15/912,118

(22) Filed: Mar. 5, 2018

(65) Prior Publication Data

US 2018/0192799 A1 Jul. 12, 2018

Related U.S. Application Data

(63) Continuation-in-part of application No. 14/773,498, filed as application No. PCT/US2014/021637 on Mar. 7, 2014, now Pat. No. 9,955,804.

(60) Provisional application No. 61/791,583, filed on Mar. 15, 2013, provisional application No. 61/777,468, filed on Mar. 12, 2013, provisional application No. 61/774,808, filed on Mar. 8, 2013.

(51) Int. Cl.

| | |
|---|---|
| ***A47C 20/00*** | (2006.01) |
| ***A47G 9/10*** | (2006.01) |
| *A47C 16/00* | (2006.01) |

(52) U.S. Cl.

CPC ..... *A47G 9/1081* (2013.01); *A47C 16/00* (2013.01); *A47G 9/10* (2013.01); *A47G 2009/1018* (2013.01)

(58) Field of Classification Search

CPC ..... A47G 9/10; A47G 9/1018; A47G 9/1054; A47G 9/1072; A47G 9/1045; A47G 9/1081; A47G 2009/1018; A47G 9/1027; A47C 31/001; A47C 16/00

See application file for complete search history.

(56) References Cited

U.S. PATENT DOCUMENTS 2,880,428 A * 4/1959 Forsland ..... A47G 9/10 5/636
2,898,975 A * 8/1959 Wagner ..... A47C 27/144 267/145
3,148,389 A * 9/1964 Lustig ..... A47C 27/144 5/643

(Continued)

FOREIGN PATENT DOCUMENTS

JP 201281094 A 4/2012
JP 2012081094 A 4/2012

(Continued)

OTHER PUBLICATIONS

International Searching Authority, International Search Report and Written Opinion, dated Jul. 12, 2014, 11 pgs.

*Primary Examiner* — Nicholas F Polito
*Assistant Examiner* — Morgan J McClure
(74) *Attorney, Agent, or Firm* — Middleton Reutlinger

(57) ABSTRACT

A pillow is provided that includes a latex foam to provide comfort and support to the body of a user. The pillow includes a latex foam layer connected to at least one additional foam component. An internal foam layer is also included in the pillow, with the latex foam layer and the additional foam component disposed about the internal foam layer.

19 Claims, 7 Drawing Sheets

(56) References Cited

U.S. PATENT DOCUMENTS 3,239,854 A * 3/1966 Freedlander ..... A47C 27/144 5/636
3,242,511 A * 3/1966 Fultz ..... A47C 27/081 5/490
3,287,750 A * 11/1966 Jessup ..... A47C 27/144 297/452.27
3,757,364 A * 9/1973 Downing ..... A47G 9/10 5/636
3,815,165 A * 6/1974 Tobinick ..... A47C 27/085 5/680
4,021,871 A * 5/1977 Wortman ..... A47C 27/00 5/636
4,078,792 A * 3/1978 Arato ..... A63H 33/00 239/211
4,147,825 A * 4/1979 Talalay ..... A47C 27/144 428/138
4,508,044 A * 4/1985 Downey ..... A47G 9/10 112/420
4,776,048 A * 10/1988 Wilheim ..... B60N 2/882 5/636
4,799,275 A * 1/1989 Sprague, Jr. ..... A47G 9/10 5/636
D308,311 S * 6/1990 Forsland ..... D6/601
4,930,173 A * 6/1990 Woller ..... A47C 27/144 297/452.48
4,949,411 A * 8/1990 Tesch ..... A47G 9/10 5/636
4,959,880 A * 10/1990 Tesch ..... A47G 9/10 5/490
4,961,982 A * 10/1990 Taylor ..... A61F 5/485 112/475.08
4,975,996 A * 12/1990 Evans ..... A47C 27/146 5/727
5,138,732 A * 8/1992 Wattie ..... A47G 9/10 5/636
5,189,747 A * 3/1993 Mundy ..... A61G 5/1043 24/30.5 S
5,226,188 A * 7/1993 Liou ..... A47C 7/742 297/452.46
5,557,816 A * 9/1996 Pedersen ..... A47G 9/0207 112/475.08
5,638,564 A * 6/1997 Greenawalt ..... A47G 9/10 5/636
D385,451 S * 10/1997 Pujals, Jr. ..... D6/596
5,689,844 A * 11/1997 Liu ..... A47G 9/10 5/636
5,732,427 A * 3/1998 Parnham ..... A47G 9/1081 5/640
D395,568 S * 6/1998 Davis ..... D6/601
5,778,470 A * 7/1998 Haider ..... A47G 9/10 5/644
6,079,066 A * 6/2000 Backlund ..... A47G 9/10 5/636
6,182,312 B1 * 2/2001 Walpin ..... A47G 9/10 5/636
D456,660 S 5/2002 Landvik
6,401,279 B1 * 6/2002 Vaughn ..... A47G 9/10 5/644
6,499,164 B1 * 12/2002 Leach ..... A47C 20/021 5/630
6,541,094 B1 4/2003 Landvik et al.
6,578,218 B2 6/2003 Wassilefsky
6,602,579 B2 8/2003 Landvik
6,668,404 B2 * 12/2003 Lanteri ..... A47G 9/10 5/636
6,866,915 B2 3/2005 Landvik
6,895,619 B1 * 5/2005 Lee ..... A47G 9/10 5/630
D507,142 S * 7/2005 Akamatsu ..... D6/601
6,988,286 B2 * 1/2006 Schecter ..... A47G 9/10 5/645
D516,855 S * 3/2006 Akamatsu ..... D6/601
D517,849 S * 3/2006 Akamatsu ..... D6/601
7,051,389 B2 5/2006 Wassilefsky
7,082,633 B1 8/2006 Maarbjerg
D529,325 S 10/2006 Maarbjerg
7,155,765 B2 1/2007 Fogg
D558,499 S 1/2008 Maarbjerg
7,415,742 B2 8/2008 Wassilefsky
D575,974 S * 9/2008 Akamatsu ..... D6/601
7,434,281 B1 * 10/2008 Holliday ..... A47G 9/10 5/636
7,444,702 B2 11/2008 Fogg
7,507,468 B2 3/2009 Landvik et al.
7,594,288 B1 * 9/2009 Holliday ..... A47G 9/10 5/630
D603,643 S * 11/2009 Keefe ..... D6/601
7,707,670 B2 5/2010 Fogg
D618,029 S * 6/2010 Keefe ..... D6/601
7,735,169 B2 6/2010 Wassilefsky
7,794,507 B2 9/2010 Bishop et al.
7,874,624 B2 * 1/2011 Ito ..... A47C 27/12 297/452.48
7,878,389 B2 * 2/2011 Rudduck ..... A47G 29/1201 109/38
8,025,964 B2 9/2011 Landvik et al.
8,034,445 B2 10/2011 Landvik et al.
8,656,537 B2 * 2/2014 Leifermann ..... A47G 9/10 5/636
8,667,699 B2 * 3/2014 MacFarlane ..... A47G 9/0253 33/512
8,719,981 B2 * 5/2014 Jaskot ..... A47G 9/10 5/636
8,991,921 B2 3/2015 Peterson
9,015,884 B2 * 4/2015 Herrnsdorf ..... A47G 9/10 5/636
9,232,867 B2 * 1/2016 Chang ..... A47G 9/10
2001/0021438 A1 9/2001 Landvik
2002/0078507 A1 * 6/2002 Pearce ..... A47C 3/16 5/644
2004/0033351 A1 2/2004 Landvik et al.
2005/0076446 A1 4/2005 Fogg
2005/0084667 A1 4/2005 Landvik et al.
2005/0202214 A1 9/2005 Landvik
2005/0223493 A1 * 10/2005 Setokawa ..... A47G 9/1036 5/636
2005/0278852 A1 * 12/2005 Wahrmund ..... A47G 9/1081 5/636
2006/0059628 A1 * 3/2006 Hamilton ..... A47C 4/52 5/653
2006/0174414 A1 8/2006 Maarbjerg
2006/0277684 A1 12/2006 Wassilefsky
2007/0094803 A1 5/2007 Fogg
2009/0320209 A1 * 12/2009 McCain ..... A47C 27/007 5/636
2011/0061167 A1 * 3/2011 Farley ..... A47G 9/10 5/652
2012/0060846 A1 * 3/2012 Leoniak ..... A61F 5/56 128/845
2012/0073057 A1 * 3/2012 Sramek ..... A47G 9/109 5/645
2012/0102654 A1 5/2012 Lee
2012/0204350 A1 * 8/2012 Katsnelson ..... A47G 9/1027 5/644
2014/0230152 A1 * 8/2014 Wootten, Jr. ..... A47G 9/10 5/645
2014/0283305 A1 * 9/2014 Zysman ..... A47C 27/148 5/636
2015/0182042 A1 * 7/2015 Jensen ..... A47G 9/04 5/636

FOREIGN PATENT DOCUMENTS

KR 1020100107889 A 10/2010
WO 0180690 A1 11/2001

* cited by examiner

LATEX FOAM PILLOW

RELATED APPLICATIONS

This continuation-in-part application claims priority and benefit of, under 35 U.S.C. § 120, to U.S. application Ser. No. 14/773,498, filed Sep. 8, 2015, which is a national stage entry of PCT Application No. PCT/US14/21637, filed Mar. 7, 2014, which claims priority to: U.S. Provisional Application Ser. No. 61/791,583, filed Mar. 15, 2013; U.S. Provisional Application Ser. No. 61/777,468, filed Mar. 12, 2013; and U.S. Provisional Application Ser. No. 61/774,808, filed Mar. 8, 2013, the entire disclosures of each of which are incorporated herein by this reference.

TECHNICAL FIELD

The present invention relates to pillows having a latex foam layer and at least one additional foam component. In particular, the present invention relates to pillows including a latex foam layer and an additional foam component that are each disposed about an internal foam layer to provide comfort and support to the body of a user, or a portion thereof, resting on the pillow.

BACKGROUND

As is generally the case with pillows, the effectiveness and desirability of the pillow is partly a function of well the pillow supports the body of a user and partly a function of how well the pillow conforms to the body of a user and provides a feeling of softness. In this regard, many users find pillows comprised of latex foam to be particularly desirable, as such pillows provide an increased amount of support to the body of a user and offer an orthopedically correct sleeping position that reduces and prevents pain in the body of a user, or a portion thereof, resting on such a pillow. That increased amount of support, however, is often accompanied by an increased amount of heat retention in that latex pillow, as well as an increased cost that leaves many users looking for suitable alternatives to latex foam pillows.

SUMMARY

The present invention includes pillows having a latex foam layer and at least one additional foam component. In particular, the present invention relates to pillows including a latex foam layer and an additional foam component that are each disposed about an internal foam layer to provide comfort and support to the body of a user, or a portion thereof, resting on the pillow.

In one exemplary embodiment of the present invention, a pillow is provided that includes an internal foam layer having a first surface and a second surface. The pillow also includes a latex foam layer, along with an additional foam component in the form of a flexible foam layer, that are each disposed about the internal foam layer. The latex foam layer is generally comprised of a planar piece of flexible latex foam having a first abutment end and a second abutment end. The flexible foam layer, on the other hand, can be comprised of a variety of different foams and includes a first mating end, which is connected to the first abutment end of the latex foam layer, and a second mating end, which is connected to the second abutment end of the latex foam layer. In this regard, once connected, the latex foam layer and the flexible foam layer thus form a continuous outer foam layer that substantially surrounds the internal foam layer of the pillow.

By wrapping the latex foam layer and the additional foam component (or flexible foam layer) around the internal foam layer, the latex foam layer and the flexible foam layer are generally positioned and configured to both form the longitudinal edges of the pillow as well as the support surfaces of the pillow. For example, in some embodiments, the latex foam layer forms a first longitudinal edge of the pillow, and the flexible foam layer forms a second longitudinal edge of the pillow, with both the first longitudinal edge and the second longitudinal edge of the pillow having an arcuate shape. In some embodiments, the latex foam layer and the flexible foam layer can further be positioned such that the latex foam layer substantially covers the first surface of the internal foam layer and the flexible foam layer substantially covers the second surface of the internal foam layer. In this regard, in some embodiments, the latex foam layer and the flexible foam layer each form a support surface of the pillow.

Regardless of the particular configuration, the latex foam layer, the internal foam layer, and the additional foam component (or flexible foam layer) are each generally comprised of a foam that is capable of suitably distributing the pressure from a user's body, or portion thereof, across the pillow. In some embodiments, the internal foam layer, the additional flexible foam layer, or both are comprised of a visco-elastic foam. In certain embodiments, the latex foam of the latex foam layer has a hardness, density, or both that is different than that of the flexible foam layer, such that a pillow can be provided where one support surface of the pillow provides a softer surface on which to rest, while the other support surface of the pillow provides a desired amount of support. In further embodiments, the internal foam layer has a hardness, density, or both that is different from the latex foam layer, the flexible foam layer, or both to further modify the feel and comfort of the pillow (e.g., softer or more firm).

To further enhance the comfort, in some embodiments, the pillow further includes one or more additional features to increase the comfort of a user lying on the pillow. For example, in some embodiments, to increase the movement of air through the pillow and reduce the retention of heat in the pillow, the latex foam layer defines a plurality of columnar voids that extend through the latex foam layer and are in fluid communication with the internal foam layer to allow for an increased amount of air to travel through and dissipate heat away from the internal foam layer and the remainder of the pillow.

In addition to having a plurality of columnar voids that provide enhanced air flow, in some embodiments, the pillow includes an outer cover that surrounds the latex foam layer and the flexible foam layer. Such an outer cover is typically comprised of a textile having a sufficient amount of durability, but that also has a sufficient amount of breathability to allow air and heat to travel through the outer cover and away from the pillow. For instance, in some embodiments, the outer cover is comprised of one hundred percent cotton.

According to some illustrative embodiments, a pillow comprises a first foam portion and a second foam portion, each of the first and second foam portions having an outermost surface capable of supporting a user; the first foam portion being one of firmer or softer than the second foam portion, the first and second foam portions each extending at opposite ends of the pillow about a horizontal axis from an upper side to a lower side, the upper side of the first foam portion being of a different length than the lower side, the upper side of the second foam portion being of a different length than the lower side, wherein the pillow provides four distinct feels by rotating the pillow about at least one of a vertical axis or a horizontal axis.

According to some optional embodiments, the following features may be used alone or in combination with other optional features set forth herein. The pillow may further comprise a first orientation providing a first feel of the four feels, a second orientation providing a second feel of the four feels, a third orientation providing a third feel of the four feels and a fourth orientation providing a fourth feel of the four feels. The first orientation may provide a firm feel under a user's neck and a soft feel under a user's head. The second orientation may provide a soft feel under a user's neck and a firm feel under a user's head. The pillow may provide a soft feel under both a user's neck and head. Finally, the pillow may provide a firm feel under both a user's neck and head. Further, the pillow may further comprise a plurality of apertures extending across one of the first foam portion and the second foam portion. The first foam portion may be generally J-shaped and the second foam portion may be generally J-shaped. Still further, one of the first and second foam portions may have a plurality apertures wherein the aperture define rows in at least one direction. The apertures may be disposed along the outermost surface and about the ends said horizontal axis and further wherein the apertures closest to an end of said pillow have an axis at an angle to those along the outermost surface. Alternatively, the apertures closest to an end of the pillow have an elongate shape. The first foam portion may be bonded to the second foam portion. One of the first foam portion and the second foam portion may be a latex foam. The other of the first foam portion and the second foam portion may be one of a visco-elastic foam, latex foam, reticulated viscoelastic foam, non-reticulated viscoelastic foam, reticulated non-visco elastic foam, non-reticulated non-viscoelastic foam, polyurethane foam, soy foam, expanded polymer foam. In some embodiments, both of the first and second foam portions may be comprised of latex foam. Further, both of the first and second foam portions may be selected from the group consisting of visco-elastic foam, latex foam, reticulated viscoelastic foam, non-reticulated viscoelastic foam, reticulated non-viscoelastic foam, non-reticulated non-viscoelastic foam, polyurethane foam, soy foam, expanded polymer foam. The first foam portion and the second foam portion may each define an arcuate portion at the opposite ends of the pillow and which extend about the horizontal axis.

According to some embodiments, a pillow may comprise a first foam portion and a second foam portion, each of the first and second foam portion having an outermost surface, which supports a user, and inner surfaces which are bonded together, the first foam portion being one of firmer or softer than the second foam portion, the first and second foam portions each having an arcuate portion at opposite ends of the pillow which extends about a horizontal axis from an upper side of the pillow to a lower side of the pillow, the upper side of said first foam portion being of a different length than the lower side, a plurality of apertures disposed on the upper side and the arcuate portion of the first foam portion, wherein one of: (a) the apertures of said upper side being at one angle and at least some of the apertures of said arcuate portion being at a different angle than said aperture of said upper side or (b) at least one row of holes closest to an end of the pillow are elongate in shape, further wherein the pillow provides four distinct feels by rotating the pillow about a vertical axis and about a horizontal axis.

Further features and advantages of the present invention will become evident to those of ordinary skill in the art after a study of the description, figures, and non-limiting examples in this document.

DESCRIPTION OF EXEMPLARY EMBODIMENTS

Figure 2:
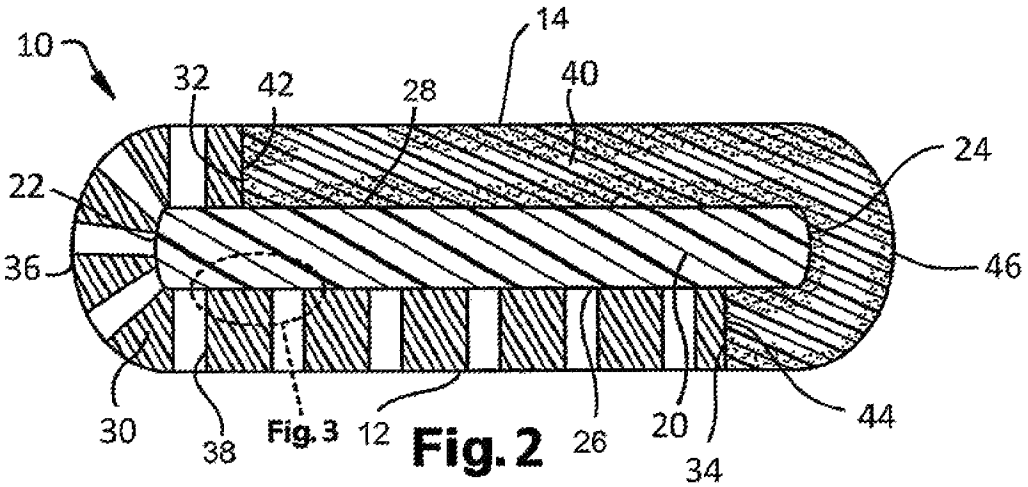
FIG. 2 is a cross-sectional view of the exemplary pillow of FIG. 1 taken along line 2-2 of FIG. 1.

The present invention includes pillows having a latex foam layer and at least one additional foam component. In particular, the present invention relates to pillows including a latex foam layer and an additional foam component that are each disposed about an internal foam layer to provide comfort and support to the body of a user, or a portion thereof, resting on the pillow.

Referring first to FIGS. 1-4, in one exemplary embodiment of the present invention, a pillow 10 is provided that includes an internal foam layer 20 having a first surface 26 and a second surface 28. The pillow 10 also includes a latex foam layer 30 and an additional foam component, in the form of a flexible foam layer 40, that are each disposed about the internal foam layer 20. The latex foam layer 30 is comprised of a substantially rectangular piece of flexible latex foam having a first abutment end 32 and a second abutment end 34 opposite the first abutment end 32. The flexible foam layer 40 is similarly comprised of a substantially rectangular piece of foam, and includes a first mating end 42, which is connected to the first abutment end 32 of the latex foam layer 30, and a second mating end 44, which is connected to the second abutment end 34 of the latex foam layer 30. In this regard, by connecting the first mating end 42 of the flexible foam layer 40 to the first abutment end 32 of the latex foam layer 30, and by connecting the second mating end 44 of the flexible foam layer 40 to the second abutment end 34 of the latex foam layer 30, the latex foam layer 30 and the flexible foam layer 40 thus form a continuous outer foam layer that substantially surrounds the internal foam layer 20 of the pillow 10.

By positioning and configuring the latex foam layer 30 and the flexible foam layer 40 around the internal foam layer 20, the latex foam layer 30 and the flexible foam layer 40 generally form both the longitudinal edges of the pillow, as well as the support surfaces of the pillow. In particular, in the exemplary embodiment shown in FIGS. 1-4, the latex foam layer 30 forms a first longitudinal edge 36 of the pillow 10, and the flexible foam layer 40 forms a second longitudinal edge 46 of the pillow 10. Both the first longitudinal edge 36 and the second longitudinal edge 46 have an arcuate shape by virtue of the connection of the first and second abutment ends 32, 34 of the latex foam layer 30 with the mating ends 42, 44 of the flexible foam layer 40, and by virtue of positioning the internal foam layer 20 in the internal cavity created by the latex foam layer 30 and the flexible foam layer 40.

Additionally, in the exemplary embodiment shown in FIGS. 1-4, the latex foam layer 30 is positioned such that it substantially covers the first surface 26 of the internal foam layer 20 and forms a first support surface 12 of the pillow 10, while the flexible foam layer 40 is positioned such that is substantially covers the second surface 28 of the internal foam layer 20 and forms a second support surface 14 of the pillow 10. In this regard, the latex foam layer 30 and the flexible foam layer 40 of the pillow 10 are thus positioned and configured to provide two different support surfaces 12, 14 of the pillow 10, thereby providing a pillow 10 that provides a different feel to a user resting on the pillow 10 depending on whether the user is resting their body, or a portion thereof, on the first support surface 12 or second support surface 14 of the pillow 10, as described in further detail below.

Referring still to FIGS. 1-4, the internal foam layer 20 is a substantially rectangular piece of foam having a first longitudinal edge 22 and a second longitudinal edge 24 opposite the first longitudinal edge 22. The first longitudinal edge 22 of the internal foam layer 20 is positioned adjacent to first longitudinal edge 36 of the pillow 10, and the second longitudinal edge 24 of the internal foam layer 20 is positioned adjacent to the second longitudinal edge 46 of the pillow 10. The result is a pillow 10 with a generally rectangular shape with both the first longitudinal edge 36 and the second longitudinal edge 46 having an arcuate shape. However, it is contemplated that the internal foam layer 20 could also have other shapes including contoured, curvilinear or non-planar shapes, which would result in a different overall shape of the pillow 10. For example, if the internal foam layer 20 had a cylindrical shape and was positioned in the internal cavity created by the latex foam layer 30 and the flexible foam layer 40, the overall pillow 10 would also have a cylindrical shape.

Regardless of the particular configuration, the latex foam layer 30, the internal foam layer 20, and the flexible foam layer 40 are each generally comprised of a foam that is capable of suitably distributing the pressure from a user's body or portion thereof across the pillow 10. Such foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, soy foam, expanded polymer foams (e.g., expanded ethylene vinyl acetate, polypropylene, polystyrene, or polyethylene), and the like. Furthermore, the foams may include gel additives or inserts.

Of course, the latex foam layer 30 of the pillow 10 is comprised primarily of latex foam. Latex is a stable dispersion (emulsion) of polymer microparticles in an aqueous medium, with the microparticles preferably having a size range of about 10 to 1000 nm. Latexes may be natural or synthetic. Thus, the latex foam for the latex foam layer 30 of the pillow 10 can be prepared, for example, from natural rubber latex or from one or more of such synthetic latexes, such as polybutadiene/styrene latex, polybutadiene/acrylonitrile latex, polychloroprene latex and the like, or from a mixture of natural rubber latex and one or more such synthetic latexes. In this regard, the latex foam for the latex foam layer 30 of the pillow 10 may include conventional latex foams, as well as visco-elastic latex foams. In some embodiments, the solids content of the latex foam is from about 20 to 75% by weight. In other embodiments, the solids content of the latex foam is from about 50 to 75% by weight.

With respect to the internal foam layer 20 and the flexible foam layer 40, one or both are generally comprised of a foam that is different that the latex foam of the latex foam layer 30. For example, one or both of the internal foam layer 20 and the flexible foam layer 40 could be comprised of a visco-elastic foam. Generally, a visco-elastic foam capable of use in an exemplary pillow of the present invention has a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam used in one or both of the internal foam layer 20 and the flexible foam layer 40 in the pillow 10 has hardness of about 10 N, about 20 N, about 30 N, about 40 N, about 50 N, about 60 N, about 70 N, or about 80 N to provide a desired degree of comfort and body-conforming qualities.

To the extent that visco-elastic foam is used in one or both of the internal foam layer 20 and the flexible foam layer 40, the visco-elastic foam can also have a density that assists in providing a desired degree of comfort and body-conforming qualities, as well as an increased degree of material durability. In some embodiments, the visco-elastic foam used in one or both of the internal foam layer 20 and the flexible foam layer 40 in the pillow 10 is no less than about 30 $kg/m^3$ to no greater than about 150 $kg/m^3$. In some embodiments, the density of the visco-elastic foam is about 30 $kg/m^3$, about 40 $kg/m^3$, about 50 $kg/m^3$, about 60 $kg/m^3$, about 70 $kg/m^3$, about 80 $kg/m^3$, about 90 $kg/m^3$, about 100 $kg/m^3$, about 110 $kg/m^3$, about 120 $kg/m^3$, about 130 $kg/m^3$, about 140 $kg/m^3$, or about 150 $kg/m^3$.

In one exemplary embodiment, and as shown FIGS. 1-4, to provide varied levels of comfort and support, the density or hardness of the latex foam layer 30 and the density or hardness of the flexible foam layer 40 are not the same. For example, in certain embodiments, the latex foam layer 30 has a density greater than the density of the flexible foam layer 40, such that the first longitudinal edge 36 and first support surface 12 of the pillow 10, which is formed by the latex foam layer 30, is configured to provide a firm surface for the user to rest his or her body, or a portion thereof, while the second longitudinal edge 46 and second support surface 14 of the pillow, which is formed of the less dense flexible foam layer 40 provides a softer surface.

Figure 1:
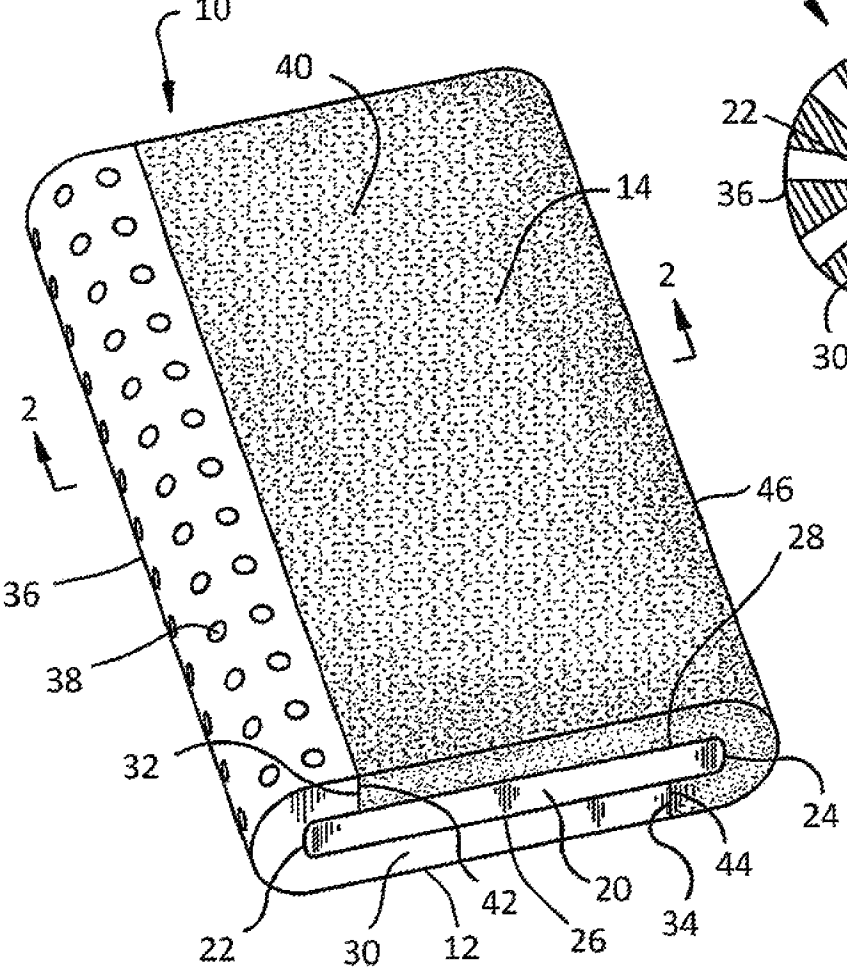
FIG. 1 is a perspective view of an exemplary pillow made in accordance with the present invention.

Furthermore, in some embodiments, the density or hardness of the internal foam layer 20 is not the same as the density or hardness of the latex foam layer 30, the flexible foam layer 40, or both the latex foam layer 30 and the flexible foam layer 40. For example, as shown in FIGS. 1-2, the body of a user, or a portion thereof, positioned on the first or second support surfaces 12, 14 of the pillow 10 would be supported by multiple layers of foam, i.e., the internal foam layer 20, the latex foam layer 30, and the flexible foam layer 40. The different densities and/or hardnesses of the foam layers 20, 30, 40 allows for even greater variation in the levels of comfort and support provided by the pillow 10. For example, in the exemplary pillow 10 shown in FIGS. 1-4, the density of the internal foam layer 20 is greater than the density of the latex foam layer 30, and the flexible foam layer 40, to thereby provide stiffness and support in the middle of the pillow 10. As such, the first support surface 12, in combination with the underlying dense internal foam layer 20, would provide a greater amount of support to the body of the user than the first longitudinal edge 36, which is comprised only of the less dense latex foam layer 30. Similarly, the second support surface 14 would provide greater support to the body of the user than the second longitudinal edge 46.

Of course, the selection of foams having a particular density or hardness will affect other characteristics of the foam, including the manner in which the foam responds to pressure and the overall feel of the foam. It should be appreciated though that a foam having a desired density and hardness can readily be selected for a particular application or support cushion (e.g., pillow) as desired.

Figure 3:
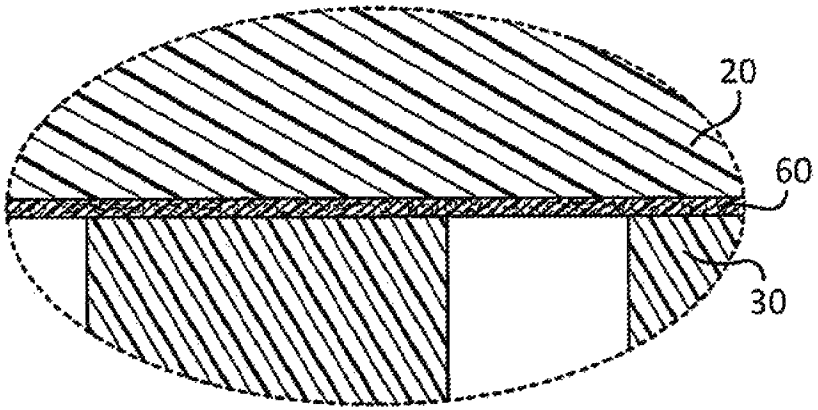
FIG. 3 is an enlarged, partial cross-sectional view of the exemplary pillow of FIG. 1 showing an adhesive area of the pillow.
Figure 4:
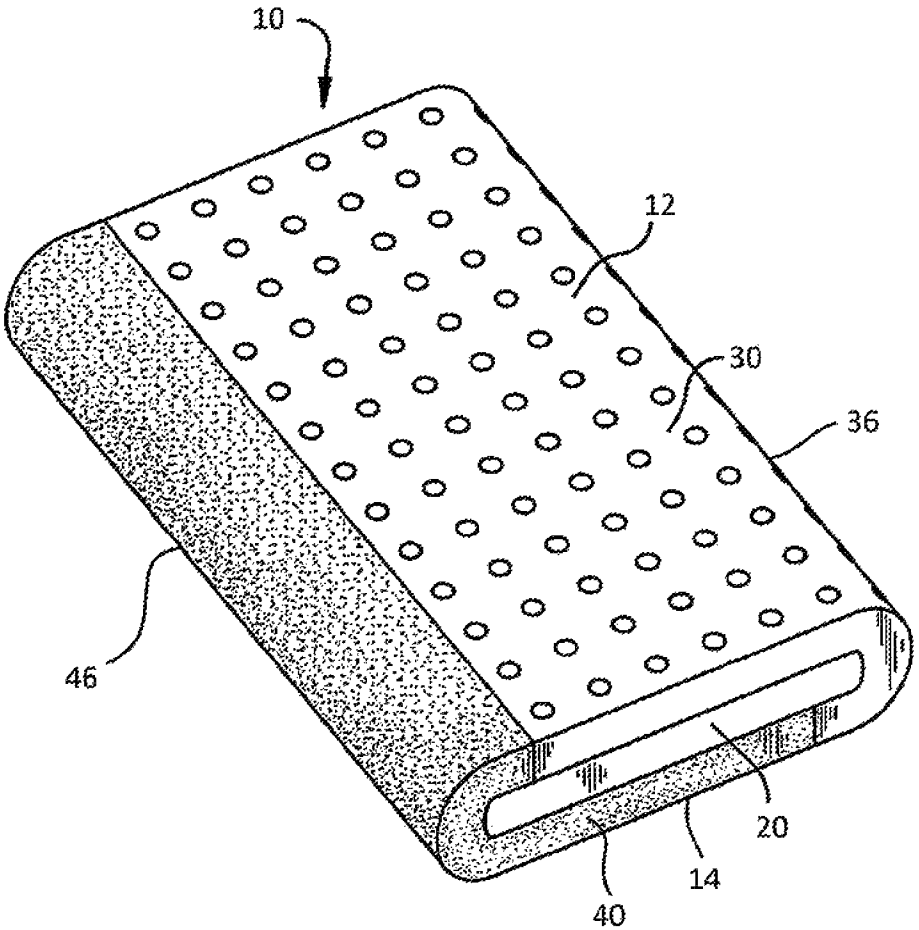
FIG. 4 is an another perspective view of the exemplary pillow of FIG. 1.

Referring still to FIGS. 1-4, in this exemplary embodiment, and as a further refinement, the latex foam layer 30 defines a plurality of columnar voids 38 that extend through the latex foam layer 30 and are in fluid communication with the internal foam layer 20. The columnar voids 38 allow for air to more readily travel through the latex foam layer 30 and for heat retained by the pillow 10 to more readily dissipate away from the pillow 10. As best shown in FIG. 4, the columnar voids 38 are arranged in a regular grid-like pattern throughout the latex foam layer 30 to help ensure uniform movement of air and a uniform dissipation of heat away from the internal foam layer 20 and the remainder of the pillow 10. However, it is also contemplated that voids having various sizes and shapes could also be included in an exemplary pillow, as may be desired for a particular application or user, without departing from the spirit and scope of the present invention. For example, for users prone to excessive heating during sleep, it is contemplated that an exemplary pillow could be provided having voids with larger diameters positioned in a central region of the pillow that would be in contact with the portion of the body of the user that is prone to excessive heating.

Although not shown in FIGS. 1-4, as a further refinement, to enhance the comfort of the pillow 10, the pillow 10 may also be provided with an outer cover (or pillowcase) that surrounds the pillow 10. Such an outer cover is typically comprised of a textile having a sufficient amount of durability to protect the underlying the pillow, but also having a sufficient amount of "breathability" to allow air and heat to travel through the outer cover. In some embodiments, the outer cover is comprised of one hundred percent cotton, which typically allows for sufficient movement of air through the pillow. In some embodiments, the outer cover can also include an amount of a flame-retardant material, such that a flame-retardant barrier surrounds and protects the foam of the underlying pillow. Of course, numerous other textiles, including silk and textiles having a lower percentage of cotton, could also be readily used to fabricate an outer cover without departing from the spirit and scope of the present invention.

Referring again to the exemplary embodiment shown in FIGS. 1-4, the foam layers 20, 30, 40 of the pillow preferably have different densities and/or hardnesses. As the pillow 10 could be susceptible to shifts in the foam layers 20, 30, 40 with respect to one another, adhesive areas are used to stabilize the internal foam layer 20, the latex foam layer 30, and the flexible foam layer 40 with respect to one another. The adhesive areas comprise a material mimicking the properties and chemical makeup of the adhering surfaces to avoid any type of barrier or harder area which would provide discomfort to a user or would impart adverse properties on the final construction of the pillow. For example, in certain embodiments, a latex adhesive is used, as further described below.

FIG. 3 is an enlarged, partial cross-sectional view of the exemplary pillow of FIG. 1 showing an adhesive area of the pillow. As shown, in this exemplary embodiment, the latex foam layer 30 adheres to internal foam layer 20, and the adhesive area is an adhesive layer 60 comprised of a chemical or compound with chemical or mechanical properties similar to both the latex foam layer 30 and the internal foam layer 20. Thus, the adhesive layer 60 becomes intertwined or bonded within the top layer or surface of latex foam layer 30 and the internal foam layer 20. The chemical properties of the adhesive layer 60 are close enough to the surrounding layers 20, 30 of foam that the surfaces of the latex foam layer 30 and the internal foam layer 20 interact to create a nearly indistinguishable bond.

In some embodiments, where there is an adhesive area between two layers of a latex foam, a latex adhesive is used. When cured or dried, the latex adhesive has a flexibility and plasticity that is very close to that of the material of the surrounding latex foam layers. Accordingly, when the latex adhesive is cured/dried, the latex component of the adhesive is the same as or closely similar to the latex in the foam layers, so that the presence of the adhesive between the layers of latex foam, or between latex foam and another type or types of foam, is imperceptible. In other words, the latex adhesive acts homogeneously with latex-containing foam, so that the presence of adhesive or an adhesive layer or boundary is imperceptible.

In some embodiments, such a latex adhesive is made from latex, a thickener and a cure package. In some embodiments, the latex is primarily a natural latex. In other embodiments, the latex is a mixture of from 80-100% natural latex and from 0-20% synthetic latex. The cure package typically is made from cure-related items and other additive materials which initiate and control the curing process and bring other desirable properties to the final latex adhesive. The thickener is chosen for its ability to increase the viscosity of the compound.

While various embodiments are possible and are directly related to the ultimate properties desired, in one particular exemplary embodiment, the following formulations and ratios are used:

TABLE 1

| | Weight Percent |
|---|---|
| Latex | 80.0 to 98.7% |
| Master-batch/Cure Package | 1.0 to 10.0% |
| Thickener | 0.3 to 10.0% |

In an alternative embodiment, the thickener comprises 0.5% to 5.0% of the total weight of the latex adhesive. In some embodiments, the thickener is a polyacrylate, which increases the viscosity of the latex adhesive. In other embodiments, the thickener is any suitable material which can increase the viscosity of the latex compound, while still allowing the latex adhesive to retain its overall properties and integrity. Typically, the thickener is white, clear, or neutral in color.

In another alternative embodiment, the cure package comprises 2.0% to 7.0% of the total weight of the latex adhesive. In some embodiments, the cure package is a synthetic and/or natural rubber latex vulcanization package consisting of sulfur, zinc oxide, accelerators, accelerator activator and antioxidant to promote vulcanization with heat and protect the finished latex adhesive from oxidative aging.

In one particular exemplary embodiment, the cure package itself includes the following formulation and ratios:

TABLE 2

| | Weight Percent |
|---|---|
| Sulfur | 15-40% |
| ZnO | 20-45% |
| Accelerator(s) | 15-45% |
| Accelerator Activator (s) | 0-20% |

The latex (natural and synthetic), master-batch/cure system, and thickener are mixed or combined to form a latex adhesive which can be used anywhere a soft pliable glue bond is required such as, but not limited to, a latex to latex bond, latex to foam bond, fiber to foam bond, and foam to foam bond. In some embodiments, the latex adhesive is applied at an elevated temperature (heat), or, in some other embodiments, at room temperature. The main goal of the latex adhesive is to mimic the viscoelastic properties of the two adhering surfaces and, in turn, avoiding a hard layered surface or seam which, in some instances, is undesirable.

The latex adhesive can be applied to the surfaces in a variety of manners based on the application involved or the machinery available for production. In some embodiments, the latex adhesive is sprayed onto the surfaces with a spray gun. In other embodiments, the latex adhesive is applied with one or more brushes, rollers spongers, or other such applicators. In still other embodiments, the latex adhesive is poured onto one or more surfaces and spread as needed. In other embodiments, the latex adhesive is adhered in a sheet-like manner. In other embodiments, the latex adhesive is used in a gel-like application. In other embodiments, the latex adhesive is applied at or near room temperature, while, in other embodiments, heat is used to activate and start the curing and bonding process.

In some embodiments, the latex adhesive has a density and hardness that provides good performance and adhesion results while in use, but also, after setting, has characteristics related to comfort of the user. In this regard, the latex adhesive does not harden over time, as such hardening can compromise the comfort of the final user, particularly when one or more layers are utilized or one or more adhesive layers 60 are used.

Figure 5:
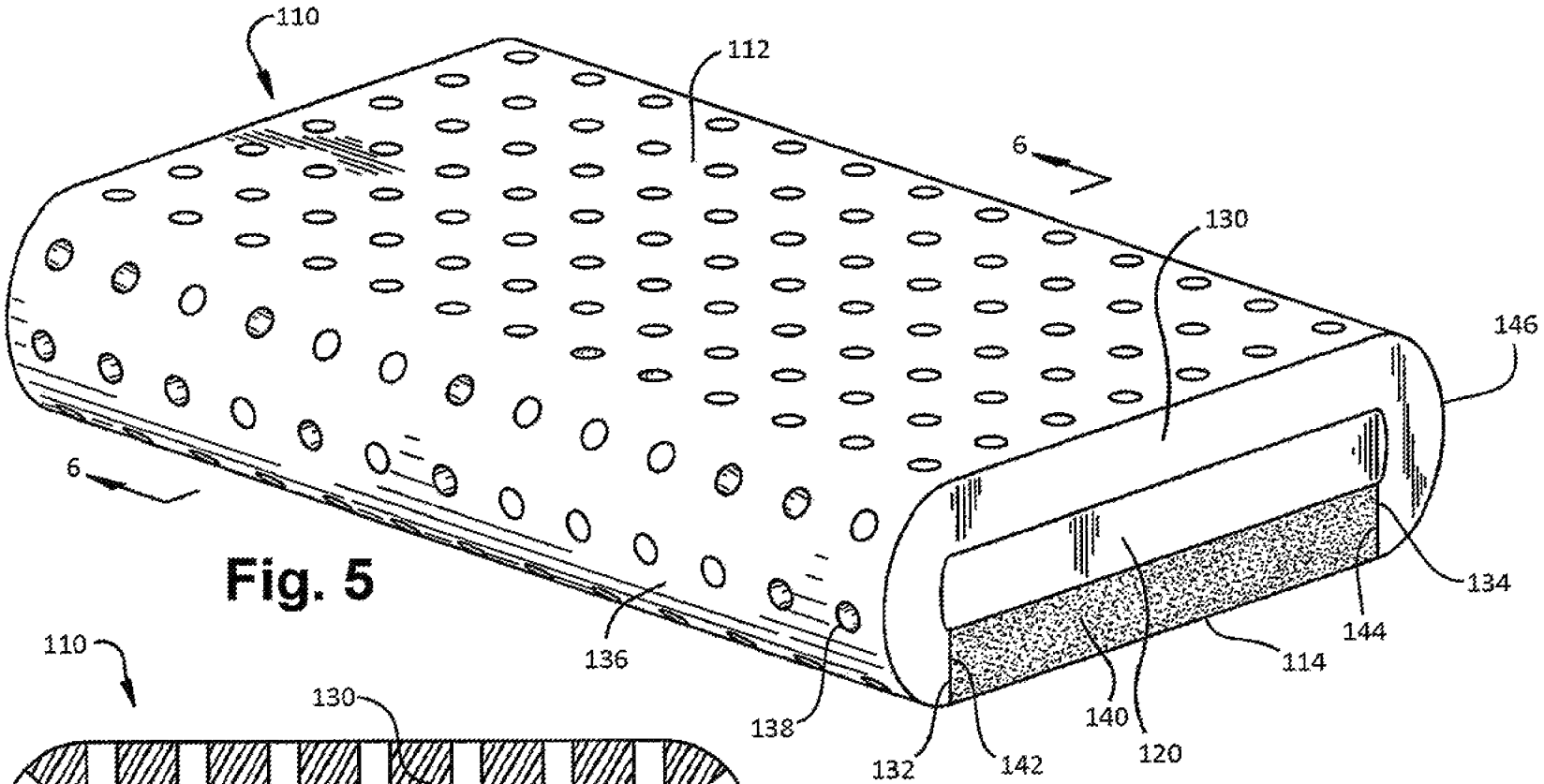
FIG. 5 is a perspective view of another exemplary pillow made in accordance with the present invention.
Figure 6:
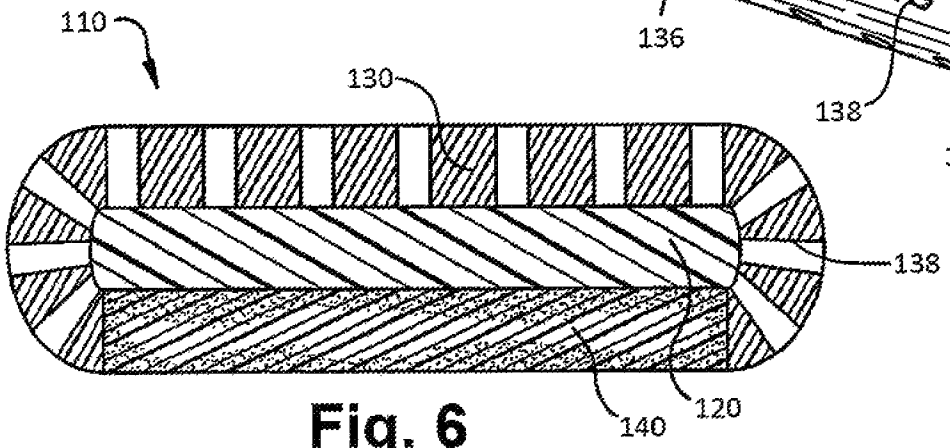
FIG. 6 is a cross-sectional view of the pillow of FIG. 5 taken along line 6-6 of FIG. 5.

With further respect to the use of different foam layers in an exemplary pillow of the present invention, and referring now to FIGS. 5-6, in another exemplary embodiment of the present invention, a pillow 110 is provided that, like the pillow 10 shown in FIGS. 1-4, includes an internal foam layer 120, a flexible foam layer 140, and a latex foam layer 130 that defines a plurality of columnar voids 138. Also, like the pillow 10 shown in FIGS. 1-4, the latex foam layer 130 is connected by first and second abutment ends 132, 134 to first and second mating ends 142, 144 of the flexible foam layer 140 to form a continuous outer foam layer that substantially surrounds the internal foam layer 120. Furthermore, the latex foam layer 130 of the pillow 110 also forms a first support surface 112 of the pillow 110 and the flexible foam layer 140 forms a second support surface 114 of the pillow 110. Unlike the pillow shown in FIGS. 1-4, however, the latex foam layer 130 forms both a first longitudinal edge 136 and a second longitudinal edge 146 of the pillow 110.

Figure 7:
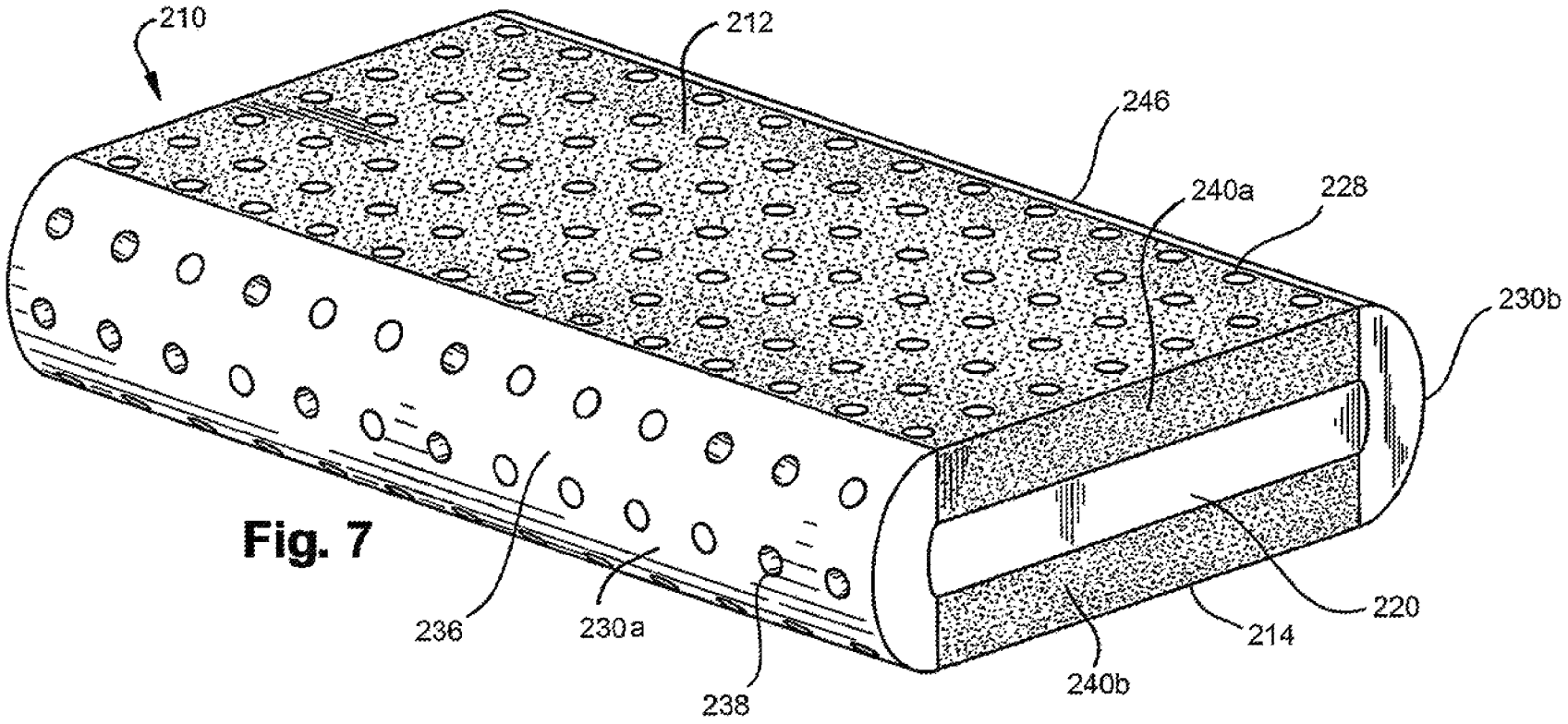
FIG. 7 is a perspective view of another exemplary pillow made in accordance with the present invention.

Referring now to FIG. 7, in yet another exemplary embodiment of the present invention, a pillow 210 is provided that also includes an internal foam layer 120. Unlike the pillows 10, 110 shown in FIGS. 1-4 and 5-6, however, the pillow 210 does not make use of a single flexible foam layer and a single latex foam layer. Rather, the pillow 210 includes a first flexible foam layer 240*a* and a second flexible foam layer 240*b* that form the first support surface 212 and the second support surface 214 of the pillow 210, respectively. Also, unlike the pillows 10, 110 shown in FIGS. 1-4 and 5-6, the pillow 210 also includes a first latex foam layer 230*a* that forms a first longitudinal edge 236 of the pillow 210, and a second latex foam layer 230*b* that forms a second longitudinal edge 238 of the pillow 210. Furthermore, as also shown in FIG. 7, both the first latex layer 230*a* and the first flexible foam layer 240*a* define a plurality of columnar voids 238 to dissipate heat away from the internal foam layer 220 and the remainder of the pillow 210.

As yet another refinement of the present invention, although the embodiments shown in FIGS. 1-7 are in the form of pillows and will typically have a width in a range of 20 to 50 inches, a length in a range of 20 to 50 inches, and a thickness in a range of 1 to 6 inches such that the pillows are dimensionally-sized to support the head of a user, it is contemplated that the features described herein are equally applicable to numerous other support cushions and the like. Such additional support cushions can include, but are not limited to, mattresses, seat cushions, seat backs, neck pillows, leg spacer pillows, mattress toppers, overlays and the like. As such, the phrase "support cushion" can be used herein to refer to any and all such objects having any size and shape, and that are generally capable of or are generally used to support the body of a user of a portion thereof.

Referring now to FIGS. 8-12, at least one additional embodiment is provided which utilizes a design similar to FIG. 1 for a pillow 310, which provides four different feelings for a user. The pillow 310 may utilize any of the materials and material characteristics previously described. The pillow 310 does not utilize the internal foam layer as depicted in FIG. 1 but may have other similar characteristics. In the instant embodiment, the pillow 310 is shown having an oblong shape similar to the previous embodiments but various shapes may be utilized. The pillow 310 is formed of a first foam portion or layer 340 and a second foam portion or layer 330. Further, while the term "layer" is used, the depicted layers are not limited to a purely horizontal construction. One of the foam portions or layers is more firm than the other. In the instant embodiment, for purpose of the ease of description, the foam portion 340 will be indicated as the softer foam portion while the second, lower foam portion 330, will be indicated as the firmer foam portion. Further, while these views FIGS. 8-11 are shown in side schematic orientations, one of the foam portions or layers is shown with a cross-hatch not to indicate a section view but more so to easily distinguish or differentiate the foam layers 330, 340 and aid in the understanding of the disclosure.

The first foam portion 340 of the pillow 310 is also defined by an upper side 342, a lower side 344 and an arcuate portion 346, which is formed at an end of the upper side 342 and extends about a horizontal axis Z (FIG. 12) to join the upper and lower sides 342, 344. Each of the first foam portion 340 and second foam portion 330 have these upper side and lower side arcuate portions 336, 346. However, it should be understood by one skilled in the art that while the upper side 342 is shown on the top side of the pillow 310, this is due to the orientation. Such orientation of the pillow 310 may be flipped in order to provide that the lower side 332 becomes the upper side. Thus, the terms "upper" and "lower" are merely descriptive but not limiting since the pillow is intended to be rotated and/or flipped over. Alternatively, the upper side 342 may be referred to as the first side, the lower side 344 may be referred to as the second side and these labels may also be used for the foam portion 330. Thus, with reference to the second foam portion 330, there may be a first side 332, a second side 334, and an arcuate portion 336, which join the two sides 332, 334, together. These arcuate portions 336, 346 may be formed integrally with the first and second foam portions 330, 340, or may be bonded or added on independently of the first and second sides 342, 344. Further, it will be understood by one skilled in the art, that this first side 342, 332 is the longer segment and the second side 344, 334 is a shorter segment. The arcuate portions 336, 346 both extend about a horizontal Z-axis extending into the page as viewed in FIG. 8.

Figure 8:
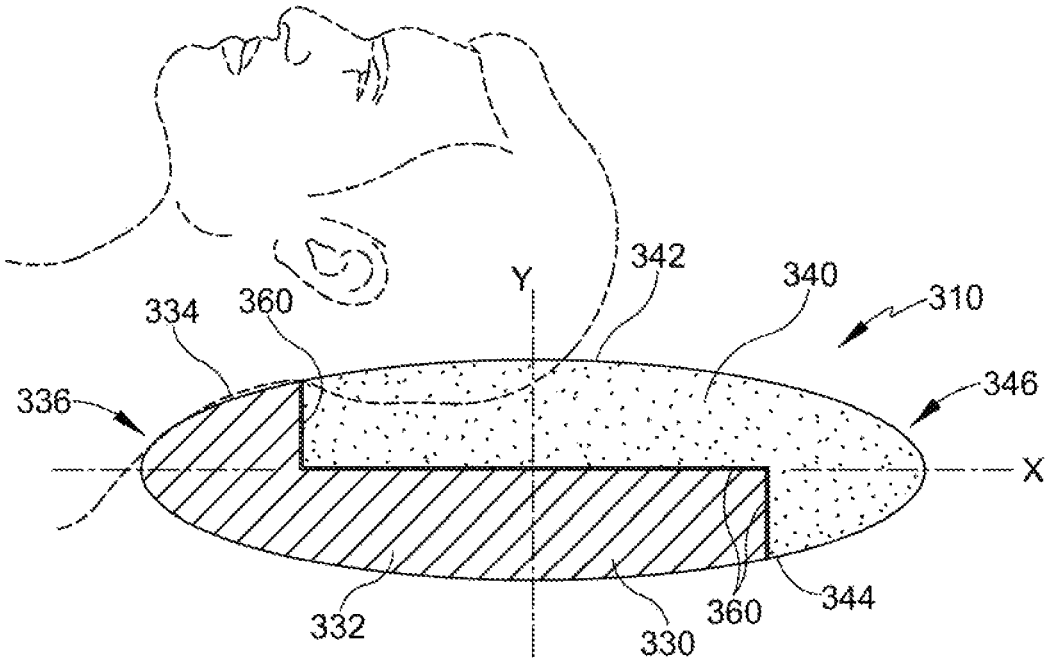
FIG. 8 is a first side view of an alternate embodiment of the pillow, providing a first feeling.

The first foam portion 340 and the second foam portion 330 may be generally J-shaped with interlocking arrangement so that the first and second foam portions 330, 340 may be formed and bonded together to manufacture the pillow 310. Each of the first and second foam portions 340, 330 have abutting surfaces extending in three dimensions in order to improve adhesion of the two foam portions or layers 330, 340. As shown in FIG. 8, a heavy line represented by adhesive 360 is shown moving through the X-axis and Y-axis. Further, the adhesive 360 may extend into the page in the Z-axis direction. The foam portions 330, 340 may alternatively be may be alternative shapes, such as L-shaped or other shapes, depending on the overall shape of the pillow 310.

Also shown in the depicted embodiment are X and Y axes. The X-axis is horizontal and the pillow 310 is shown rotated about this axis to orient the firm foam portion 340 downwardly, and the soft foam portion 340 upwardly. Also shown is the Y-axis about which the user may rotate the pillow as well. For purpose of these descriptions and ease of understanding, a user's head and shoulders are disposed on the left-hand side of the figure for the following descriptions of FIGS. 8-11, for consistency and ease of explanation.

With the user's head, neck and shoulders positioned on the left-hand side of the pillow 310, the firm foam portion 330 is generally positioned under the user's neck, while the user's head rests on the first soft foam portion 340. This provides the user with a first feel when using the pillow 310.

Figure 9:
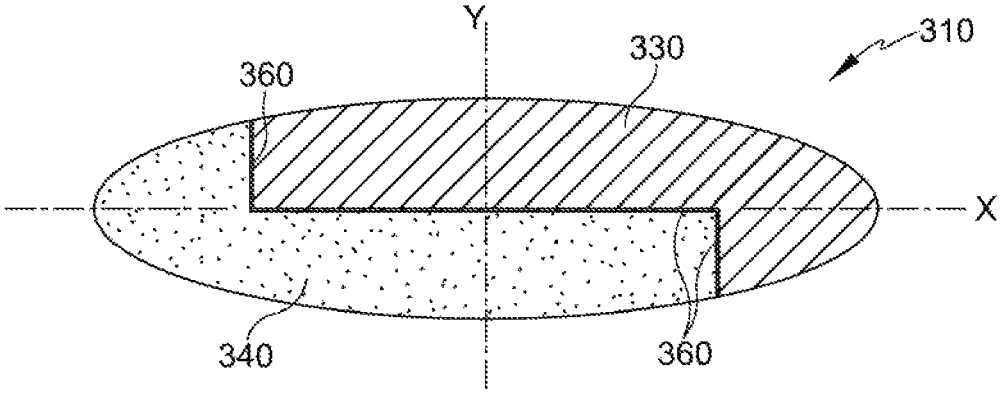
FIG. 9 is a second side view of the pillow of FIG. 8, providing a second feeling.

Referring now to FIG. 9, the pillow 310 is shown rotated from its position in FIG. 8 about the X-axis and the Y-axis of FIG. 8 so that the firm foam portion 330 is on top and the soft foam portion 340 is primarily along the bottom with the soft portion 340 to the left-hand side of the pillow 310, for purpose of these descriptions. In the instant orientation, the pillow 310 provides that the soft foam portion 340 is under the user's neck and the firmer foam portion 330 is primarily under the user's head.

Figure 10:
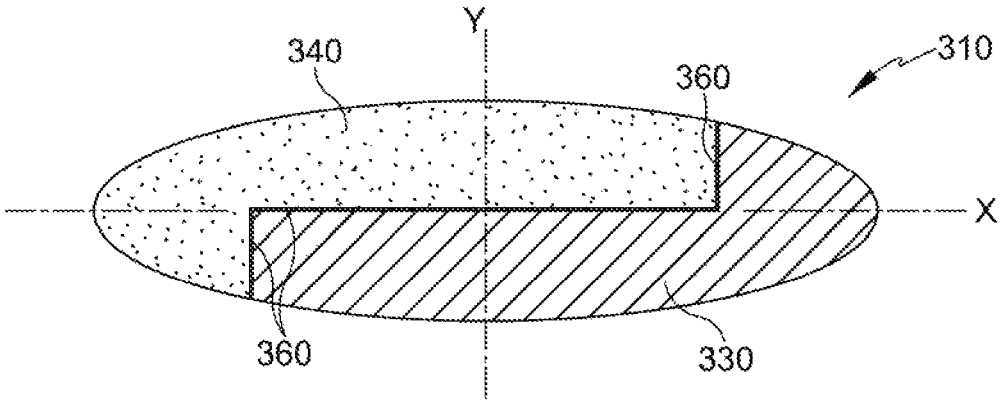
FIG. 10 is a third view of the pillow of FIG. 8, providing a third feeling.

Referring now to FIG. 10, the pillow 310 is rotated from its position in FIG. 8 about the Y-axis only. In this embodiment, the first foam portion 340 is still primarily on the upper side and toward the left-hand side of the pillow 310 and the second foam portion 330 is disposed on the bottom side and toward the right-hand side of the pillow 310. In this embodiment, again with the user's head, neck and shoulders disposed on the left-hand side of the pillow 310, the user feels the soft support under the neck and under the head providing a distinct feel from the orientations described in FIGS. 8 and 9.

Figure 11:
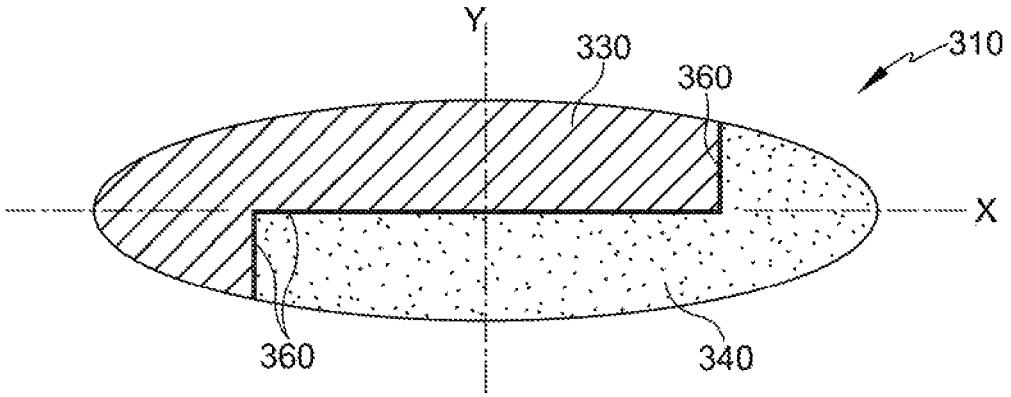
FIG. 11 is a fourth view of the pillow of FIG. 8, providing a fourth feeling; and, FIG. 12 is a perspective view of the pillow of FIGS. 8-11.

Finally, with reference to FIG. 11, the pillow 310 is shown rotated from the orientation of FIG. 8 only about the X-axis. In this orientation, the first, softer foam portion 340 is disposed downwardly and to the right while the second, firmer foam portion 330 is disposed primarily upwardly and toward the left. Again, with the user's neck and head disposed on the left hand side of the pillow 310, a further distinct feeling is provided with the firm foam portion 330 under both the neck and head.

Figure 12:
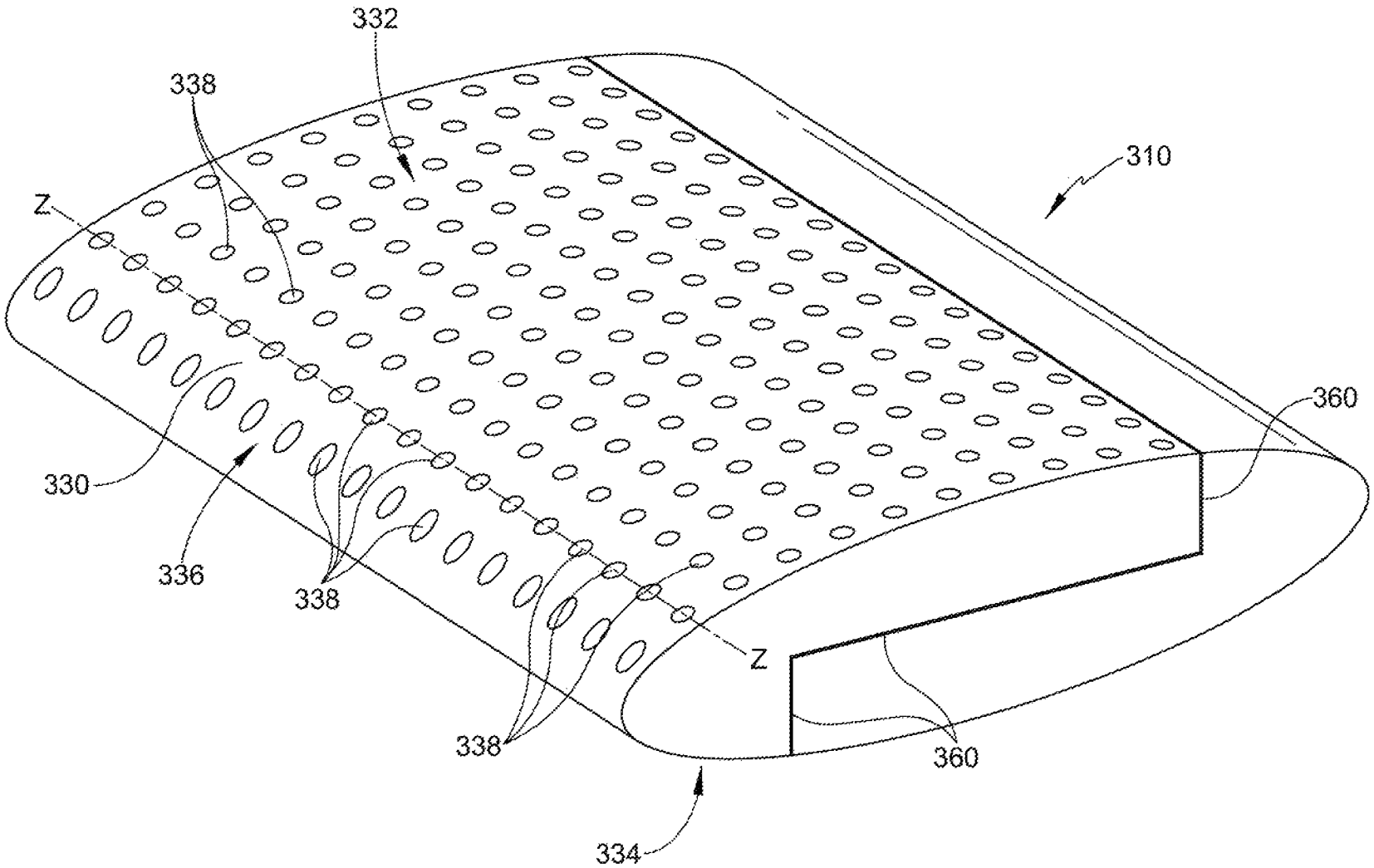

Referring now to FIG. 12, an illustrative view of pillow 310 is depicted with the soft foam portion 340 of the pillow 310 upwardly, in the orientation of FIG. 10. In the instant embodiment, the firm foam portion 330 is shown having a plurality of apertures 338. The apertures 338 are disposed along the upper side 332 and may or may not be disposed on the lower side 334, as well as through the arcuate portion 336 therebetween. The upper side 332 may be flat as in previous embodiments or alternatively may be slightly curved as shown in the embodiments of FIG. 8-12. Further, the arcuate portion 336 curves so that the first side 332 changes to the second, lower side 334 beyond a horizontal axis extending through the pillow 310. As the arcuate portion 336 extends about the horizontal Z-axis generally near an end of the pillow 310, the apertures 338 may stop or may continue about the arcuate portion 336 extending from the first side 332 and to the second side 334, as with the previous embodiments. The apertures 338 may define rows in one direction or two directions. The apertures 338 may also be randomly spaced. The embodiment depicted provides that the one or both portions 330, 340 may be formed with holes 338 or alternatively may be cut in the foam during or after the foam portions 330, 340 formation. The foam portions 330, 340 may be cut into the desired shape, for example, the j-shapes depicted and glued together.

Still referring to FIG. 12, the last row of apertures 338 are slightly elongated or oblong, relative to the aperture 338 closer to the top of the pillow 310. The elongate shape may occur when the foam portion 330 is cut near the end closest to, and about the depicted z-axis. In embodiments of the pillow where the foam portion 330 is folded or bent around the end, the axes of the holes may vary in angle or direction closer to the end of the pillow which bends or folds about the z-axis. However, in pillows wherein the shape is cut, rather than folded, the axes of apertures 338 may not vary or may only vary slightly. More likely however, if the apertures 338 are close enough to the end of the pillow to interact with the cutting blade, one skilled in the art will understand that the upper end of the holes may take an elongate or oblong appearance. In this embodiment, the apertures 338 may be formed so as to be oriented vertically in the same orientation across the surface of the foam portion, for example they may all be oriented vertically as depicted. Further, one skilled in the art should understand that while the apertures 338 are shown in foam portion 330, it may also be that the apertures 338 may be formed alternatively and/or additionally in the foam portion 340.

The following list of references are incorporated herein by reference:

REFERENCES

1. U.S. Pat. No. 8,034,445 to Landvik, et al., issued Oct. 11, 2011, and entitled "Laminated Visco-Elastic Support."

2. U.S. Pat. No. 8,025,964 to Landvik, et al., issued Sep. 27, 2011, and entitled "Laminated Visco-Elastic Support."
3. U.S. Pat. No. 7,794,507 to Bishop et al., issued Sep. 14, 2010, and entitled "Textile Treatment."
4. U.S. Pat. No. 7,735,169 to Wassilefsky, issued Jun. 15, 2010, and entitled "Comfort Pillow."
5. U.S. Pat. No. 7,707,670 to Fogg, issued May 4, 2010, and entitled "Pillow top for a Cushion."
6. U.S. Pat. No. 7,507,468 to Landvik, et al., issued Mar. 24, 2009, and entitled "Laminated Visco-Elastic Support."
7. U.S. Pat. No. 7,444,702 to Fogg, issued Nov. 4, 2008, and entitled "Pillow top for a Cushion."
8. U.S. Pat. No. 7,415,742 to Wassilefsky, issued Aug. 26, 2008, and entitled "Comfort Pillow."
9. U.S. Design Pat. No. D558,499 to Maarbjerg, issued Jan. 1, 2008, and entitled "Pillow."
10. U.S. Pat. No. 7,155,765 to Fogg, issued Jan. 2, 2007, and entitled "Pillow top for a Cushion."
11. U.S. Design Pat. No. D529,325 to Maarbjerg, issued Oct. 3, 2006, and entitled "Pillow."
12. U.S. Pat. No. 7,082,633 to Maarbjerg issued Aug. 1, 2006 and entitled "Pillow."
13. U.S. Pat. No. 7,051,389 to Wassilefsky, issued May 30, 2006, and entitled "Comfort Pillow."
14. U.S. Pat. No. 6,866,915 to Landvik, issued Mar. 15, 2005, and entitled "Cushion."
15. U.S. Pat. No. 6,602,579 to Landvik, issued Aug. 5, 2003, and entitled "Cushion."
16. U.S. Pat. No. 6,578,218 to Wassilefsky, issued Jun. 17, 2003, and entitled "Leg Spacer Pillow."
17. U.S. Pat. No. 6,541,094 to Landvik, et al., issued Apr. 1, 2003, and entitled "Laminated Visco-Elastic Support."
18. U.S. Design Pat. No. D456,660 to Landvik, issued May 7, 2002, and entitled "Contoured Head Pillow."
19. U.S. Patent Application Publication No. 2007/0094803 by Fogg, published May 3, 2007, and entitled "Pillow top for a Cushion."
20. U.S. Patent Application Publication No. 2006/0277684 by Wassilefsky, published Dec. 14, 2006, and entitled "Comfort Pillow."
21. U.S. Patent Application Publication No. 2006/0174414 by Maarbjerg, published Aug. 10, 2006, and entitled "Pillow."
22. U.S. Patent Application Publication No. US2005/0202214 by Landvik, published Sep. 15, 2005, and entitled "Cushion."
23. U.S. Patent Application Publication No. 2005/0084667 by Landvik, et al., published Apr. 21, 2005, and entitled "Laminated Visco-Elastic Support."
24. U.S. Patent Application Publication No. 2005/0076446 by Fogg, published Apr. 14, 2005, and entitled "Pillow top for a Cushion."
25. U.S. Patent Application Publication No. 2004/0033351 by Landvik, et al., published Feb. 19, 2004, and entitled "Laminated Visco-Elastic Support."
26. U.S. Patent Application Publication No. 2001/0021438 by Landvik, published Sep. 13, 2001, and entitled "Cushion."

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A pillow, comprising:

a first J-shaped foam portion and a second J-shaped foam portion, each of said first and second J-shaped foam portions having abutting ends to define a continuous outermost surface capable of supporting a user;

said ends of said first J-shaped foam portion and said second J-shaped foam portion forming an abutment seam on an upper side and a lower side, said first J-shaped foam portion having a long segment and short segment and said second J-shaped foam portion having a long segment and short segment;

said first J-shaped foam portion being one of firmer or softer than the second J-shaped foam portion;

said first and second foam J-shaped portions each extending at opposite ends of the pillow about a horizontal axis defining said upper side and said lower side;

said upper side of said first J-shaped foam portion being of a different length than said lower side;

said upper side of said second J-shaped foam portion being of a different length than said lower side;

wherein said pillow provides four distinct feels by rotating the pillow about at least one of a vertical axis or a horizontal axis.

2. The pillow of claim 1 further comprising a first orientation providing a first feel of said four feels, a second orientation providing a second feel of said four feels, a third orientation providing a third feel of said four feels and a fourth orientation providing a fourth feel of said four feels.

3. The pillow of claim 2 further comprising said first orientation with a firm feel under a user's neck and a soft feel under a user's head.

4. The pillow of claim 3 further comprising said second orientation with a soft feel under a user's neck and a firm feel under a user's head.

5. The pillow of claim 4 further comprising said third orientation with a soft feel under both a user's neck and head.

6. The pillow of claim 5 further comprising said fourth orientation with a firm feel under both a user's neck and head.

7. The pillow of claim 1 further comprising a plurality of apertures extending across one of said first J-shaped foam portion and said second J-shaped foam portion.

8. The pillow of claim 1, said first J-shaped foam portion being generally J-shaped.

9. The pillow of claim 8, said second J-shaped foam portion being generally J-shaped.

10. The pillow of claim 9 wherein one of said first and second J-shaped foam portions having a plurality apertures wherein said aperture define rows in at least one direction.

11. The pillow of claim 10 wherein said apertures are disposed along said outermost surface and about said ends and said horizontal axis and further wherein said apertures closest to an end of said pillow have an axis at an angle to those along the outermost surface.

12. The pillow of claim 10 wherein said apertures closest to an end of said pillow have an elongate shape.

13. The pillow of claim 1 wherein said first J-shaped foam portion is bonded to the second J-shaped foam portion.

14. The pillow of claim 1 wherein one of the first J-shaped foam portion and the second J-shaped foam portion is a latex foam.

15. The pillow of claim 14 wherein the other of the first foam portion and the second J-shaped foam portion is one of a visco-elastic foam, latex foam, reticulated viscoelastic foam, non-reticulated viscoelastic foam, reticulated non-viscoelastic foam, non-reticulated non-viscoelastic foam, polyurethane foam, soy foam, expanded polymer foam.

16. The pillow of claim 1 wherein both of the first and second J-shaped foam portions are comprised of latex foam.

17. The pillow of claim 1 wherein both of the first and second J-shaped foam portions are selected from the group consisting of visco-elastic foam, latex foam, reticulated viscoelastic foam, non-reticulated viscoelastic foam, reticulated non-viscoelastic foam, non-reticulated non-viscoelastic foam, polyurethane foam, soy foam, expanded polymer foam.

18. The pillow of claim 1, wherein the first J-shaped foam portion and the second J-shaped foam portion each define an arcuate portion at said opposite ends of said pillow and which extend about said horizontal axis.

19. A pillow, comprising:

a first J-shaped foam portion and a second J-shaped foam portion, each of said first and second J-shaped foam portions having abutting ends to define a continuous outermost surface capable of supporting a user;

said first and second J-shaped foam portions having inner surfaces which are bonded together;

said ends of first J-shaped foam portion and said second J-shaped foam portion forming an abutment seam on an upper side and a lower side, said first J-shaped foam portion having a long segment, a short segment, and an arcuate portion between the long and short segments, and said second J-shaped foam portion having a long segment, short segment, and an arcuate portion between the long and short segments;

said first J-shaped foam portion being one of firmer or softer than the second J-shaped foam portion;

said arcuate portions each being located at opposite ends of the pillow and extend about a horizontal axis between said upper side of said pillow and said lower side of said pillow;

a plurality of apertures disposed on said upper side and said arcuate portion of said first J-shaped foam portion;

wherein one of: (a) said apertures of said upper side being at one angle and at least some of said apertures of said arcuate portion being at a different angle than said apertures of said upper side or (b) at least one row of holes closest to an end of said pillow are elongate in shape;

further wherein said pillow provides four distinct feels by rotating the pillow about a vertical axis and about a horizontal axis.

* * * * *